United States Patent [19]

Kipp

[11] 4,020,988

[45] May 3, 1977

[54] CARTON WITH CONTOURED, RECESSED BOTTOM WALL

[75] Inventor: Michael A. Kipp, Phoenixville, Pa.

[73] Assignee: Container Corporation of America, Chicago, Ill.

[22] Filed: June 10, 1976

[21] Appl. No.: 694,650

[52] U.S. Cl. ..... 229/16 A; 229/1.5 B; 229/21

[51] Int. Cl.[2] ..... B65D 5/24; B65D 3/00

[58] Field of Search ..... 229/16 A, 37 R, 21, 229/1.5 B, 8

[56] References Cited

UNITED STATES PATENTS

| | | | |
|---|---|---|---|
| 2,134,321 | 10/1938 | Amberg | 229/21 |
| 2,147,087 | 2/1939 | Butler | 229/1.5 B |
| 2,232,088 | 2/1941 | Waters | 229/21 X |
| 2,240,599 | 5/1941 | Amberg | 229/16 A U |
| 2,323,287 | 7/1943 | Amberg | 229/16 A U |
| 2,385,898 | 10/1945 | Waters | 229/16 A |
| 3,713,576 | 1/1973 | Goebel | 229/21 |
| 3,743,169 | 7/1973 | Person | 229/16 A |

*Primary Examiner*—Davis T. Moorhead
*Attorney, Agent, or Firm*—Carpenter & Ostis

[57] ABSTRACT

A tubular carton is formed from paperboard and has a side wall formed from a pair of wall panels joined to each other at their edges. A bottom wall is foldably attached to a bottom edge of the sidewall. At least a portion of a fold line between the bottom wall and the side wall is curved providing contoured, recessed bottom wall when the carton is set up.

7 Claims, 10 Drawing Figures

CARTON WITH CONTOURED, RECESSED BOTTOM WALL

BACKGROUND OF THE INVENTION

1. Field of the Invention:

This invention relates to a carton and, more particularly, to a paperboard carton having a contoured, recessed bottom wall.

2. The Prior Art:

The art discloses various types of cartons having recessed bottoms. Such cartons require more paperboard to attain the same load capacity than the carton of the present invention because the cartons known heretofore engage the surface on which they stand, for example store shelving, along their entire lower periphery. The present carton contacts the shelving or similar supporting surface at points located in the corners of the bottom wall, or it may touch the supporting surface along only portions of its lower periphery. In the present construction the actual depth of the carton can be ascertained from the exterior of the carton without lifting the carton whereas this was not possible with known cartons as the recessed bottom could be observed only by lifting the carton and viewing it from the bottom. Such recessed bottom cartons might be misleading and might give a consumer a wrong impression of the actual capacity of the carton since, due to a recessed bottom, the capacity is smaller than it appears from the outside of the carton when the same is sitting on a shelf. A futher provision of a notched sidewall panel allows single glue application which was not possible heretofore. Also, the construction of the present carton from foldable paperboard permits placement of a separate lid on the carton.

SUMMARY OF THE INVENTION

The present invention overcomes the disadvantages of the prior art and provides a carton having a contoured, recessed bottom wall.

Generally, a tubular carton having contoured, recessed bottom wall is formed from a suitably scored and cut blank of paperboard, or the like. A side wall of the carton is formed from a pair of panels the edges of which are secured in an overlapped relationship. A bottom wall is foldably secured to the side wall panels along fold lines at least a portion of each of which is curved. A plurality of gusset panels form a gusset providing connection between certain edges of the bottom wall and certain edges of the side wall.

DRAWINGS

Figure 1:
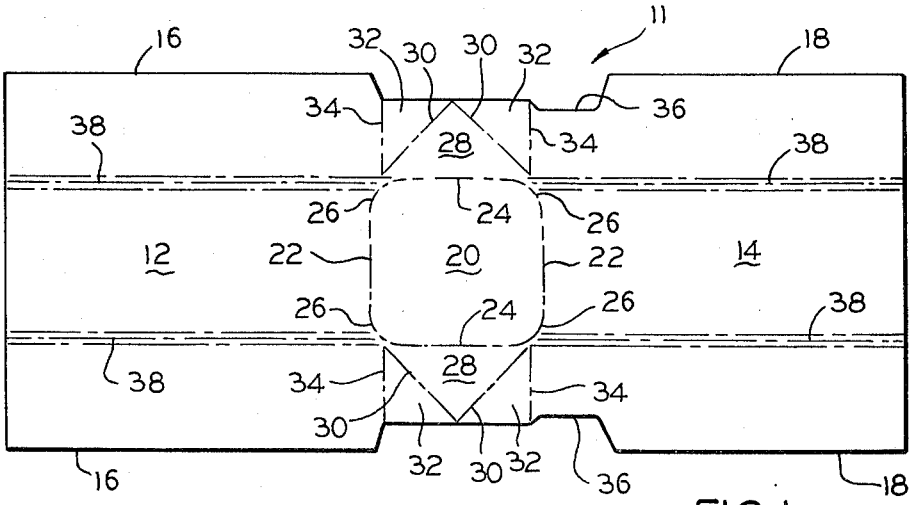
FIG. 1 is a plan view of a blank used in forming a carton representing the first embodiment of the present invention.

Referring now to the drawings, more specifically to FIGS. 1 through 4, there is shown a carton, generally designated 10, comprising the first embodiment of the present invention. The carton 10 is formed from a suitably scored and cut blank 11 of paperboard, or the like.

The blank 11 has a side wall formed from a pair of side wall forming panels 12 and 14. Free edges 16 of the panel 12 are secured by adhesive or other means well known in the art to free edges 18 of the panel 14 overlapping said edges 18 and thereby forming a tubular structure.

A bottom wall forming panel 20 is foldably secured to the side wall forming panels 12 and 14 along fold lines 22. Fold lines 24 which are substantially normal to the fold lines 22 and which join the fold lines 22 at juncture points comprising common corners 26, foldably secure the bottom wall panel 20 to a first triangular gusset panel 28.

The first gusset panel 28 is foldably attached along fold lines 30 to a pair of second triangular gusset panels 32. The gusset panels 32 are hinged to the side wall forming panels 12 and 14 along fold lines 34.

It should be noted that the distance between the fold lines 34 is smaller than the maximum width of the bottom wall panel 20 measured between the fold lines 22.

Figure 2:
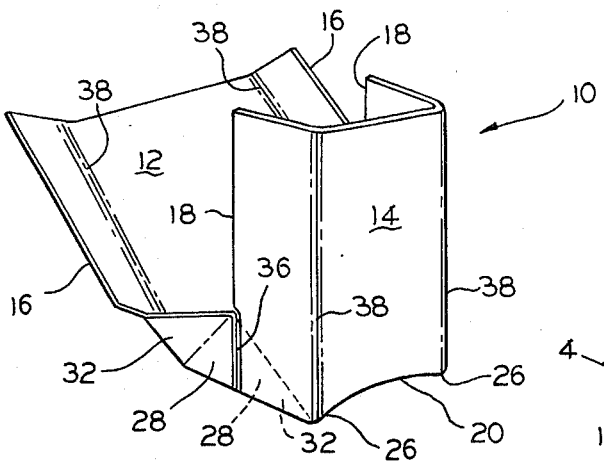
FIG. 2 is a perspective view of a partially errected carton formed from the blank shown in FIG. 1.

The panel 14 has a pair of recesses or notches 36 which greatly simplify application of adhesive to the carton when the carton is formed from the blank 11. The provision of the recesses 36 permits single line adhesive applications along the upper and lower marginal edges of the panel 12 to be used in securing the overlapping edges 16 of panel 12 to the area adjacent the edges 18 of the panel 14 at the same time securing a portion of the edge 16 which overlaps the recess 36 to the gusset panel 28 when the carton is being errected, as best seen in FIG. 2. When the gusset panel 28 is thusly secured to the marginal edge 16, a possible source of leakage from the carton is eliminated since the product cannot escape from the carton around the gusset panels 28 and 32.

Figure 3:
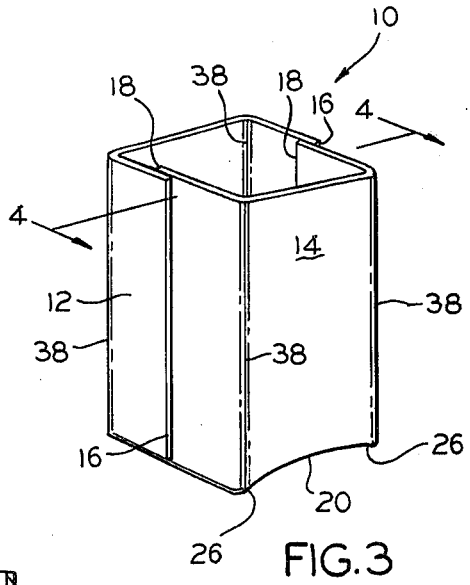
FIG. 3 is a perspective view of a carton formed from the blank illustrated in FIG. 1.
Figure 4:
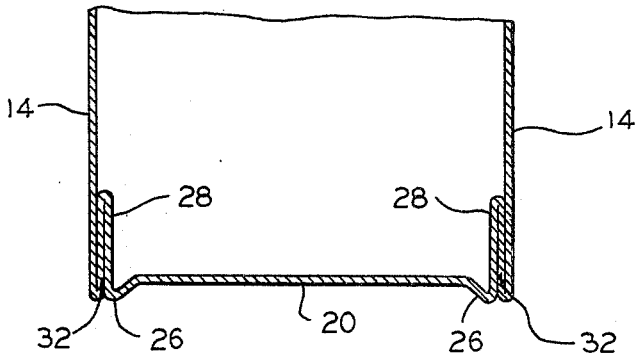
FIG. 4 is a sectional view taken generally along the line 4—4 of FIG. 3.

To achieve a better defined rounding at the corners of the side wall of a finished carton, as seen in FIGS. 2 and 3, the panels 12 and 14 are formed with desired score lines 38.

The distance between the edges 16 of the panel 12 or the distance between the edges 18 of the panel 14 is larger than the distance between the outer edges of gusset panels 32 located at both ends of the blank.

Figure 5:
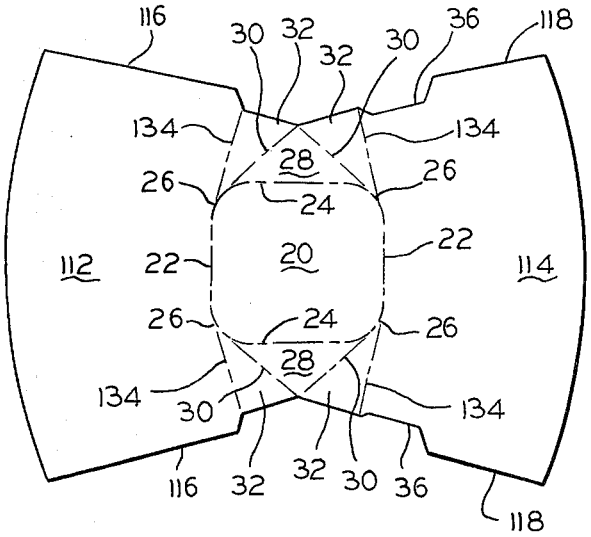
FIG. 5 is a plan view of a blank of the second embodiment of the present invention.
Figure 6:
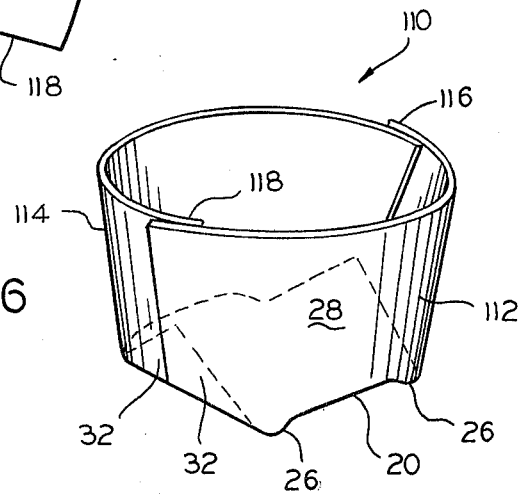
FIG. 6 is a perspective view of a carton formed from the blank of FIG. 5.

Referring now to FIGS. 5 and 6, there is shown a second embodiment of the present invention which is similar to the first embodiment described heretofore, but provides a carton 110 formed from blank 111 and having tapered side walls formed from panels 112 and 114. The panels 112 and 114 have respective diverging edges 116 and 118 secured as described in connection with edges 16 and 18. The fold lines 134 diverge toward one another instead of being substantially straight as is the case with the lines 34. Where elements in the first and second embodiment are identical, the same numerals have been used to designate them. Where the elements differ, however, the numerals used to designate elements of the second embodiment correspond to the numerals used in describing the first embodiment but have been increased by 100.

Figure 8:
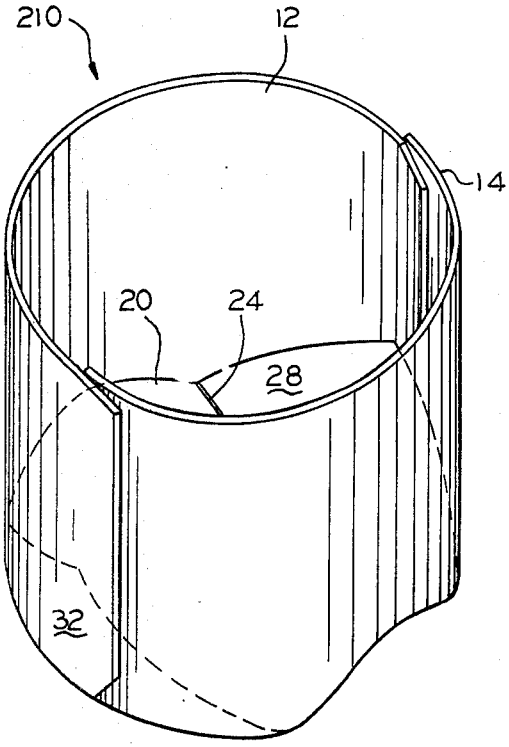
FIGS. 7 and 8 show a blank and a carton, respectively, of the third embodiment of the present invention.
Figure 7:
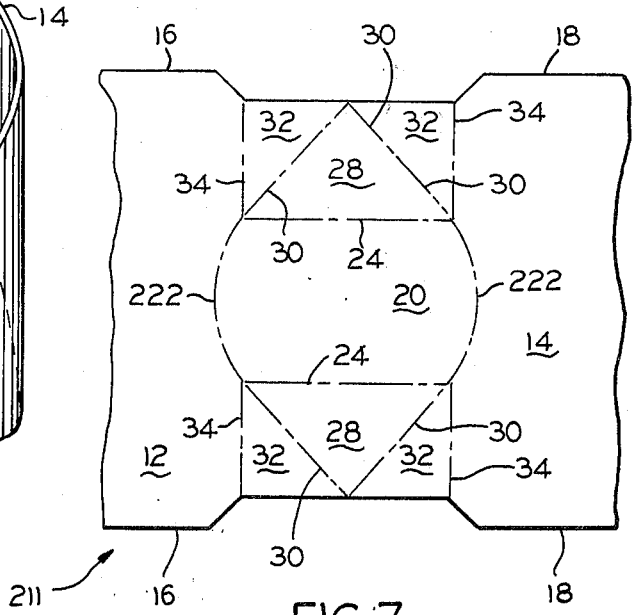

The third embodiment of the present invention is illustrated in FIGS. 7 and 8 and differs from the first embodiment in that it has a curved fold line 222 securing the bottom wall 20 to the side wall panels 12 and 14. The carton is designated 210 and the blank 211. The exemplary illustration does not show the recess or indentation 36 shown in the preceding embodiments. The elements of this embodiment which are identical to the elements of other embodiments have retained the numerals used with respect to those prior embodiments, otherwise numerals have been increased by 200.

Figure 9:
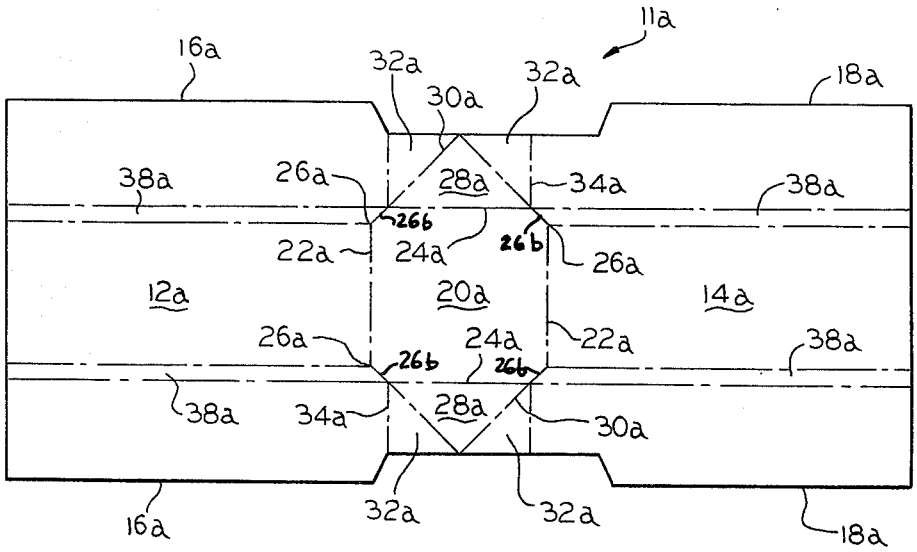
FIGS. 9 and 10 show a blank and a carton, respectively, of the fourth embodiment of this invention.
Figure 10:
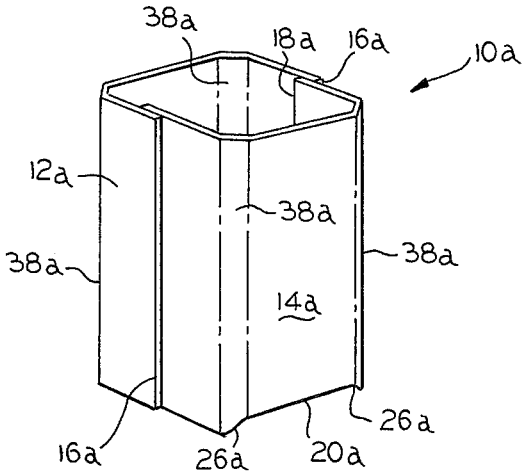

Referring now to FIGS. 9 and 10, there is shown a fourth embodiment of the present invention. The same numbering system as in the first embodiment was used with respect to the fourth embodiment except that *a* has been added to the numerals of this embodiment. Generally, the first and fourth embodiments are similar, but, in FIG. 9 the corners 26*a* are beveled and not rounded. The corners 26 of FIG. 1 are rounded and at least a portion of fold lines 22 securing the bottom wall 20 to the side walls 12 and 14 are curved. In the fourth embodiment, a portion of each fold line 22*a* is at an oblique angle to another portion 26*b* of said fold line.

As can be seen from the drawings, the formed carton has a plurality of support points corresponding to the corners 26 and 26*a* which elevate the bottom wall 20 or 20*a*, respectively, from the carton supporting surface.

I claim:

1. A tubular carton formed from a cut and scored blank of paperboard, or the like, and having a contoured, recessed bottom wall, said carton comprising:

a. a side wall formed from a pair of generally rectangular side wall panels having their edges secured in an overlapped relationship:

b. a bottom wall foldably secured at opposite side edges to bottom edges of said side wall panels along fold lines;

c. a first gusset panel foldably secured to said bottom wall along a fold line substantially normal to said fold lines between said bottom wall and said side wall panels;

d. a pair of second gusset panels each foldably secured along diverging fold lines to said first gusset panel and to a respective one of said side wall panels;

e. the distance between said fold lines securing said second gusset panels to said side wall panels being less than the maximum width of said bottom wall.

2. The carton as defined in claim 1, wherein said bottom wall is formed with rounded corners.

3. The carton as defined in claim 1, wherein said side wall has a taper extending upwardly and outwardly from the edge of said side wall located adjacent said bottom wall.

4. The carton as defined in claim 1, wherein said bottom wall has a plurality of support points for supporting said carton in an upright, errected position.

5. The carton as defined in claim 1, wherein said fold lines securing said bottom wall to said side wall panels are curved throughout their entire length.

6. The carton as defined in claim 1, wherein the distance between said fold lines securing said second gusset panels to said side wall panels is less than the maximum width of said bottom wall measured between the fold lines securing said bottom wall to said side wall panels.

7. A blank of paperboard cut and scored to form a tubular carton having a contoured, recessed bottom wall, said blank comprising:

a. a bottom wall forming panel;

b. a pair of side wall forming panels each foldably secured to a side edge of said bottom wall forming panel along a fold line at least a portion of which is at an oblique angle to another portion of said fold line;

c. a first triangular panel foldably secured to an end edge of said bottom wall forming panel along a fold line substantially normal to said fold lines between said bottom wall forming panel and said side wall forming panels;

d. a pair of second triangular panels each foldably secured along diverging fold lines to said first triangular panel and to a respective one of said side wall forming panels;

e. the distance between said fold lines securing said second triangular panels to the respective side wall forming panels being less than the maximum width of said bottom wall forming panel.

* * * * *